United States Patent [19]

Schreder

[11] Patent Number: 4,717,810

[45] Date of Patent: Jan. 5, 1988

[54] ELECTRIC HOTPLATE

[75] Inventor: Felix Schreder, Oberderdingen, Fed. Rep. of Germany

[73] Assignee: E.G.O. Elektro-Geräte Blanc u. Fischer, Fed. Rep. of Germany

[21] Appl. No.: 892,184

[22] Filed: Jul. 30, 1986

[30] Foreign Application Priority Data

Aug. 1, 1985 [DE] Fed. Rep. of Germany ..... 3527533

[51] Int. Cl.[4] ..... H05B 3/70

[52] U.S. Cl. ..... 219/457; 219/464; 219/461; 219/460

[58] Field of Search ..... 219/457, 458, 459, 460, 219/461, 463, 464

[56] References Cited

U.S. PATENT DOCUMENTS

| | | | |
|---|---|---|---|
| 1,644,255 | 10/1927 | Kercher | 219/458 |
| 1,659,774 | 2/1928 | Hicks | 219/459 |
| 2,175,824 | 10/1939 | Brey | 219/457 |
| 2,259,286 | 12/1941 | Barnsteiner et al. | 219/538 |
| 2,570,975 | 10/1951 | Osterheld | 219/459 |
| 2,933,350 | 3/1981 | Germany . | |
| 3,826,898 | 7/1974 | Hurko | 219/459 |
| 3,838,249 | 9/1974 | Detterbeck | 219/457 |
| 3,987,275 | 10/1976 | Hurko | 219/460 |
| 4,414,466 | 11/1983 | Fischer | 219/459 |
| 4,431,908 | 2/1984 | Fischer | 219/457 |

FOREIGN PATENT DOCUMENTS

| | | | |
|---|---|---|---|
| 221200 | 5/1962 | Austria | 219/461 |
| 929803 | 7/1955 | Fed. Rep. of Germany . | |
| 2729929 | 8/1980 | Fed. Rep. of Germany . | |
| 1002218 | 3/1952 | France . | |
| 1005313 | 4/1982 | France . | |
| 437636 | 11/1935 | United Kingdom . | |

*Primary Examiner*—E. A. Goldberg
*Assistant Examiner*—Teresa J. Walberg
*Attorney, Agent, or Firm*—Steele, Gould & Fried

[57] ABSTRACT

An electric hotplate, particularly intended for continuous operation in commercial use, is provided on the bottom surface with at least two superimposed reflectors (24, 28), which in each case form the lower boundary of an insulating zone (29, 30) and while incorporating an outer flange edge (4) of hotplate (2) seal the bottom surface thereof. This leads to a very low no-load power of the electric hotplate with a very rapid response to a higher power setting.

29 Claims, 19 Drawing Figures

ELECTRIC HOTPLATE

BACKGROUND OF THE INVENTION

The invention relates to an electric hotplate, particularly for continuous operation in industrial or commercial use, with a hotplate body constructed as a solid body from iron material and particularly as a casting, which forms a cooking surface on its top and within a downwardly projecting outer flange edge is provided on the bottom with at least one electrical heating element distributed over an annular heating zone, as well as a lower seal below the heating element and comprising at least two superimposed sealing parts, whilst incorporating the outer flange edge.

In certain fields electric hotplates are subject to completely different operating conditions to those normally encountered when used in domestic kitchens and in normal operation. In the latter, the electric hotplate is generally heated from the cold state for so-called parboiling initially to a relatively high operating temperature, followed by finishing boiling for a period generally less than one hour at a reduced operating temperature. However, there are also electric hotplates intended to remain in continuous operation for several hours, e.g. from morning to evening and which are therefore not switched off during a normal working day. Such electric hotplates are used in the form of large hotplates in commercial kitchens, e.g. works canteens and the like. These electric hotplates, where there is a continuous operation, must be operable both at a low no-load temperature and under a favorable finishing boiling temperature in order to obtain a low power consumption, but must still be suitable to temporarily rapidly supply the necessary increased power in a heating phase interrupting the no-load or finishing boiling phase. The no-load power is e.g. required if no cooking utensils are located on the electric hotplate for a certain amount of time, but the hotplate cannot be switched off in order to maintain the necessary permanent operational readiness. The no-load power can also be used for finishing foods in the case of a relatively low power requirement.

Hitherto, the aforementioned requirements could not be satisfied in an optimum, simultaneous manner. Thus, in general an improvement to the no-load operation, both with regards to a reduction in the no-load temperature and as regards to the no-load power requirement has led to a detectable deterioration to the heating operation with respect to speed and vice-versa and this is particularly noticed when different sizes of cooking utensil are used.

An electric hotplate of the aforementioned type is e.g. known from EP-B No. 0 024 621. This electric hotplate, which is particularly intended for normal operation and is correspondingly designed, has as the lower seal incorporating the outer flange edge, a substantially closed sheet metal cover plate engaging on said flange edge and above the same a further sealing part in the form of insulation, which contains an aluminium crinkled foil secured between the cover plate and the outer flange edge. As this design is mainly provided for shielding the electric hotplate in the downward direction by insulation, a corresponding insulation increase would be necessary to increase the shielding effect, if this electric hotplate was to be made suitable for continuous operation.

However, those electric hotplates which, instead of a solid iron material body, have a hotplate body of glass ceramic or the like are less suitable for continuous operation due to their specific characteristics. With respect to severe operating conditions, electric hotplates made from an iron material have a much longer life and due to their thermal mass can better absorb briefly occurring temperature fluctuations. In addition, the thermal stresses occurring in the case of glass ceramic plates are of a completely different type to those occurring with hotplate bodies constructed in solid form from an iron material and which have an outer flange edge, whereby said hotplate bodies can be made either from steel or as a casting, e.g. from grey cast iron. Electric hotplates with glass ceramic plates, such as are e.g. known from U.S. Pat. Nos. 3,909,592, 4,032,750, 3,733,462 and 3,987,275 are admittedly provided with reflectors below the heating elements, but for the reasons indicated hereinbefore, quite different effects occur as compared with those with an electric hotplate of the initially mentioned type.

SUMMARY OF THE INVENTION

The problem of the present invention is to provide an electric hotplate of the aforementioned type, where on the one hand it is possible in a simple manner to reduce the no-load power with a stable no-load temperature and on the other hand it can supply a greatly increased heating with a low time delay and on a temporary basis.

In the case of an electric hotplate of the aforementioned type, this problem is solved in that at least one sealing part located closer to the heating element is constructed as a reflector substantially located within the outer flange edge, at the most extending up to its bottom surface and directed against the bottom of the hotplate body and that below the same is provided an insulating zone extending at least approximately from the outer flange edge and over the heating zone so as to shield the bottom of the reflector and which is bounded by the lower sealing part. Thus, the reflector action is so limited to the area within the outer flange edge in one part with the hotplate body, that substantially all the heat irradiated downwards from the heating elements is reflected back in at least one reflector stage against the bottom of the hotplate body and the inside of the outer flange edge. A heat loss through heat conduction to the underside of the electric hotplate is simultaneously counteracted in that the insulating zone provides a shielding action against this. Thus, in superimposed arrangement are provided at least one reflector and an insulating zone within an area, which is particularly hermetically sealed on the bottom of the hotplate body and which is bounded on the outer circumference by the outer flange edge. It has been found that this leads to a very uniform and surprisingly low no-load power in the case of a relatively high temperature on the cooking surface and that the stepped combination of heat reflection and thermal insulation in the case of a brief power increase leads to an extremely low delay response of the temperature on the cooking surface.

This is particularly the case if there are provided in superimposed manner at least two successively mounted reflectors, whereof preferably the lowermost collector is arranged in an insulating zone provided below the overlaying reflector. The inventive construction has the further important advantage that it is suitable both for electric hotplates or hotplate bodies which are circular in plan view and for those which differ from the circular shape, namely e. g. for at least roughly rectangular hotplates, even if they have an edge length of 300 mm or more than 400 mm.

A further improvement to the downward thermal insulation both with respect to the heat radiation and with respect to the heat conduction or convection can be achieved if between the heating element and the reflector adjacent thereto an insulating zone is provided, whose height is smaller than that of the outer flange edge and/or is roughly the same as the height of a portion of the centre stud of the hotplate body projecting over the bottom of the heating element. Thus, the reflected heat radiation can be distributed in a simple, uniform manner over the bottom of the hotplate body.

To obtain an undelayed direct reflection, it can be advantageous if the insulating zone is at least partly and e. g. completely constructed as a cavity. Instead of this or in addition thereto, the insulating zone can be at least partly filled with a reflecting and/or thermally insulating material. A particularly advantageous construction is obtained if the insulating zone provided below the reflector adjacent to the heating element is provided connected to the underside of the seal with thermally insulating and/or reflecting material, the area located above said reflector then being constructed as an empty area or merely as an air-filled area, which is appropriately sealed in such a way that there is no air flow.

In the case of a very simple, low-weight construction, at least one thermally insulating and reflecting material layer, which in particular upwardly defines a cavity, is formed by a metallically bright crinkled foil or the like, which substantially prevents any absorption of moisture.

In order to be able to seal the bottom of the electric hotplate in an effective and stable manner, particularly against the penetration of moisture, the reflector and/or bottom of the seal is formed by a cup-shaped sheet metal cover, whose edge preferably engages on the outer flange edge.

To obtain a precisely defined engagement of the top reflector on the bottom of the hotplate body, whose surface structure is generally uneven or irregular, the edge of said reflector is appropriately at least partly provided in ring flange-like outwardly directed manner in the vicinity of the bottom of the heating element and preferably a reflector plate covering the associated cover in closed manner on the top surface is provided, which is then supported with its ring disk-like outer edge and/or via its remaining radial extension on the bottom of the heating element or the hotplate body. The edge can engage directly or indirectly on the bottom of the hotplate body or heating elements. It is possible to interpose, as a dimensional tolerance compensating plate, a thin spacing plate made from an at least partly compressible elastic material, particularly an insulating material and which is appropriately constructed in such a way that it is either self-reflecting or it allows through, in relatively low resistance manner, the thermal radiation to the reflector or reflector plate.

The edge of a lower and particularly the bottom cover plate can also be directed outwards in ring flange-like manner and preferably engages frontally on the bottom of the outer edge flange of the hotplate body. If a packing or seal is placed between the edge of the lower cover plate and the outer edge flange, which can be flat, angular or Z-shaped in cross-section, a particularly good hermetic seal is obtained, especially against the penetration of moisture, which is very advantageous for maintaining the insulating and reflecting characteristics of the different reflector and insulation arrangements in the closed space between the bottom of the hotplate body and the lower seal. The packing is appropriately made from a heat-resistant sealing material, silicone rubber, asbestos-containing sealing materials and the like being suitable. The sealing material can also be made e.g., from a hardening paste, which on pressing the cover plate against the outer flange edge adapts to the cross-sections thereof between them. Thus, the cover part can at least approximately be fixed without metal contact to the hotplate body.

It is conceivable to construct, in inwardly directed ring flange-like manner, the edge of particularly the bottom cover plate and it preferably engages on the underside of the hotplate body outside the heating element, so that the latter can also form a subassembly with the cover plate and can be positioned at a limited distance from the hotplate body to ensure direct radiation action thereon. The inwardly directed, ring flange-like edge also ensures a very precise alignment of the cover plate, including the parts provided thereon with respect to the hotplate body.

In the case of a further, constructionally very simple embodiment, which still provides a reliable seal, the edge of in particular the lower cover plate has a substantially constant width up to its upper end, so that said edge is formed by an upper portion of the circumferential wall of the cover plate which in cross-section is substantially at right angles to the cooking surface. The edge engages preferably at least approximately up to the bottom of the heating element in the inner circumference of the outer flange edge and consequently forms a double-walled circumferential seal therewith.

As a result of the construction according to the invention, the temperatures of the hotplate body in the vicinity of its exposed parts on its bottom surface can be so low, e.g. below 300° C., that the hotplate can at least partly be provided, particularly on the inner and outer circumferential surface of the outer flange edge, with a water-repelling surface coating, such as e.g. a silicone coating. This possibility particularly exists if the electric hotplate is controlled with a regulator, which limits the entire power to a maximum temperature. This control can e.g. be constructed in the manner described in German patent application No. P 34 43 529.8 and reference should be made thereto for further details.

Both the insulating and reflecting action can be considerably improved in that the filling of at least one insulating zone comprises at least two superimposed layers of approximately identical and/or different thickness, as well as in particular different materials, whereof the top one is preferably in the form of a reflector layer. The insulating material can e.g. be introduced in the form of a loose bulk material in layers corresponding to the subsequently desired layer arrangement. It can e.g. have pyrogenic silicic acid as the base material. The reinforcing fibres can be ceramic fibres, e.g. aluminosilicate fibres. It is also possible to add a hardener, e.g. high-melting glass frits, metal oxides, etc, which permit a hardening of the surface boundary layer on heating in such a way that reflector characteristics are obtained. The thermal insulating material for at least one insulating layer, particularly that engaging directly with the heating element, is appropriately formed by ceramic fibres, preferably of aluminosilicate, which are compressed to a type of plate to ensure adequate strength, but for dimensional tolerance compensation appropriately also has elastic deformability. Such a material is marketed under the trade name Fiberfrax.

The advantages according to the invention can be achieved in the case of electric hotplates with different heating systems. For example, at least one heating element can be formed by a resistance wire heating coil embedded in a ceramic embedding material in a rib-defined spiral slot on the bottom of the hotplate body and on whose bottom surface is provided preferably one insulating cavity defined by the associated reflector. The reflector which is appropriately in the form of a radiation cover leads to a marked improvement to the efficiency in the case of a very simple construction, the efficiency being further improvable by placing insulation between said cover and the lower cover plate.

In addition to or instead of said heating system, at least one heating element can be formed by a spirally positioned tubular heater pressed against the bottom of the hotplate body with a resistance heating wire enclosed in an insulating embedding material within an outer tubular jacket, said heating element being preferably pressed by means of a through, flat insulating plate by a reflector against the bottom of the hotplate body, on which the heating element engages either in a rib-defined spiral slot without embedding, or on a continuously smooth and in particular planar surface. Due to the insulating plate, the heating element is kept in good thermally coupled engagement on the hotplate body and for this purpose the insulating plate has a slight elastic deformability.

In addition to or instead of the above heating system, a heating element can also be formed by a more particularly spirally positioned radiant heater arranged in spaced manner below the bottom of the hotplate body on the top surface of an insulator constructed as a reflector and in conjunction with the solid hotplate body made from an iron material and having an outer flange edge leads to a particularly favourable thermal behaviour of the electric hotplate.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
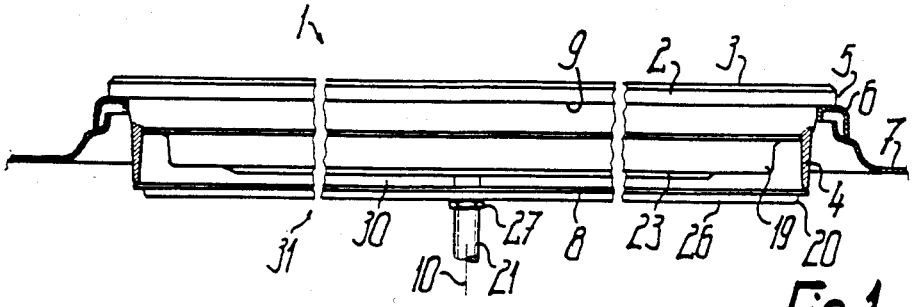
FIG. 1, an electric hotplate according to the invention in part sectional view.
Figure 2:
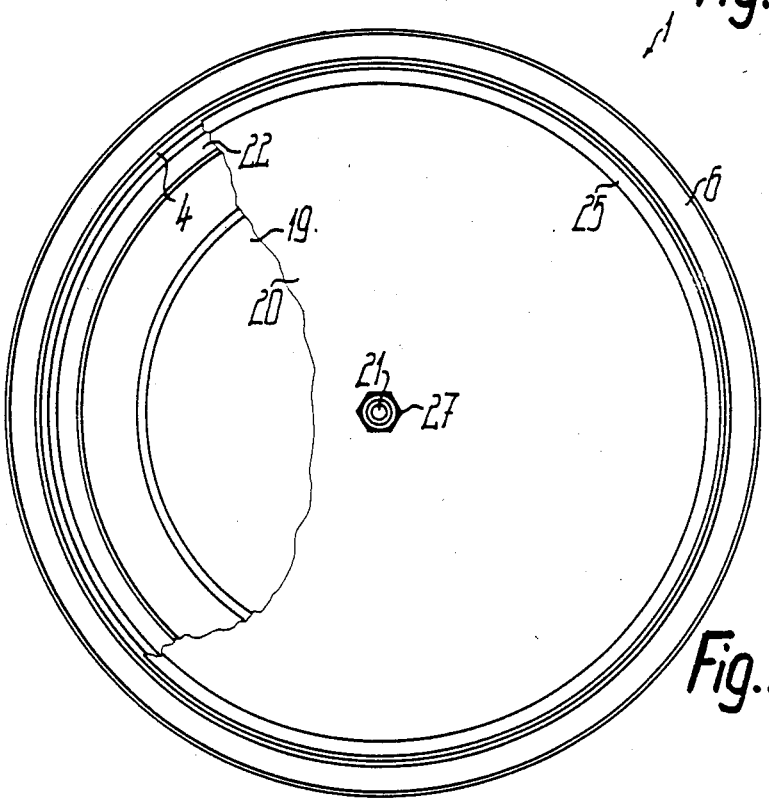
FIG. 2, the electric hotplate according to FIG. 1 in a view from below.
Figure 3:
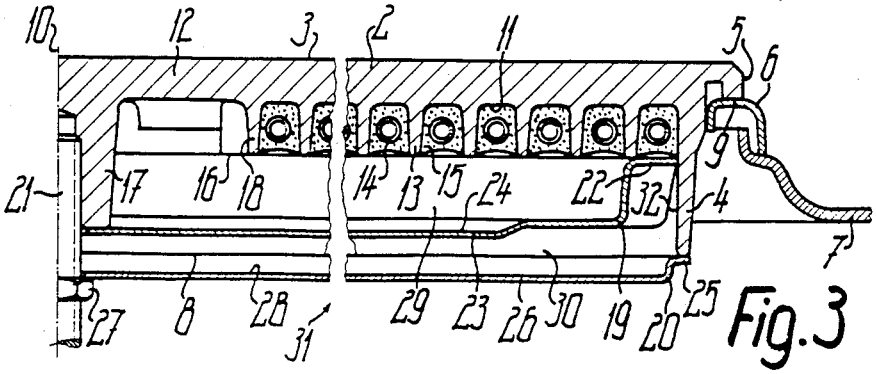
FIG. 3, a detail of FIG. 1 in a larger scale axial section.

A shown in FIGS. 1 to 3, an electric hotplate 1 according to the invention has a cast material, solid plate body 2, which is provided on its surface with an also centrally continuously planar cooking surface 3 in the form of a standing surface or base for cooking utensils. On its circumference, the cooking surface passes via a sloping bevelled surface into an upright circumferential surface 5, which is formed by a ring disk-like edge, which forms that part of the hotplate body projecting furthest over the outer circumference of body 2. An outer flange edge 4 projects downwards over the bottom of this ring disk-like edge and is constructed in one piece with the hotplate body 2 and has a roughly constant distance from the circumferential surface 5 over its entire circumference, so that in axial view it has a shape corresponding to the outer contour of the electric hotplate. This outer flange edge 4, whose wall thickness is smaller than the smallest thickness of the hotplate body in the vicinity of cooking surface 3, is cross-sectionally downwardly tapered at an acute angle and has a much greater height, by e.g. 3 to 5 times, than the ring disk-like part. The bottom 8 of the outer flange 4 forms an uninterrupted parallel end face to the cooking surface 3. From said bottom 8, the outer circumferential surface of outer flange edge 4 cross-sectionally slopes outwards at an acute angle, whilst its inner circumferential surface slopes inwards at an acute angle. In the upper area located in the vicinity of the bottom of the ring disk-like edge, its outer circumferential surface is outwardly displaced and is cross-sectionally approximately at right angles to cooking surface 3, so that in this area a spillage rim 6 can be fixed to the outer flange edge 4. This cross-sectionally, approximately U-shaped spillage rim 6 made from thin sheet metal or the like can e.g. be pressed onto the outer flange edge 4 with its inner ring part forming U-shaped legs and engages with the outside of its U-shaped cross web on the lower ring shoulder 9 of the ring disk-like edge. The spillage rim 6 projecting outwards over circumferential surface 5, when the electric hotplate 1 is incorporated into a hob 7, engages over a raised cross-sectionally stepped edge defining the associated assembly opening. The area of ring shoulder 9 adjacent to the outer circumferential surface of the outer flange edge 4 is offset with respect to said surface by a slot-like depression, so that the ring disk-like edge according to FIG. 3 in cross-section freely projects downwards in ring-like manner. Directly following onto the inner circumferential surface of outer flange edge 4 is provided on the underside of the hotplate body 2 at least one spiral slot 11 curved round the central axis 10 of hotplate body 2, which extends from the inner circumferential surface of edge 4 over only part of the distance up to central axis 10, so that body 2 is provided in the centre with a zone 12 free from heating elements and surrounding central axis 10. Spiral slot 11, which cross-sectionally downwardly widened and defined in trapezoidal manner, is defined between its turns by a spiral web 13 projecting downwards from the underside of hotplate body 2 and whose cross-sectional thickness is much smaller than the cross-sectional width of spiral slot 11. The distance of the base surface of spiral slot 11 running in a parallel plane to the cooking surface 3 is slightly larger than the cross-sectional width of spiral slot 11, said base surface being roughly level or slightly lower than the ring shoulder 9. The cross-sectional height of spiral slot 11 is slightly greater than its cross-sectional width. It is possible to provide two or more interengaging spiral slots with corresponding interengaging spiral webs, depending on the number of independently switchable heating elements used. The heating element 14 is formed by a resistance wire heating coil placed spirally and with a wall clearance on all sides in the particular spiral slot 11 and is embedded in electrically insulating manner in an embedding material 15 filling spiral slot 11. Its connection ends lead (not shown) from the bottom 16 of hotplate body 3 formed by the lower end face of spiral web 13, so that they can be connected to leads of the cooker. In the central axis 10 of hotplate body 2 is provided a centre stud 17 projecting downwards from the plane of base surface of spiral slot 11 free from the underside of hotplate body 3. The lower end face of the stud 17 parallel to cooking surface 3 is located below bottom surface 16 and above bottom surface 8 of outer flange edge 4. The outer circumferential surface of the downwardly acute-angled, conically tapered centre stud 17 is radially spaced from the inner spiral turn of spiral web 13, which therefore form an inner flange edge 18 spacedly surrounding the centre stud 17 and whose distance from the outer flange edge 4 is much larger than that from the centre stud 17.

The underside of the hotplate body 2 is closed by two superimposed sealing parts 19, 20, which are spaced from one another in contact-free manner and are e.g. fixed in the vicinity of a thread bolt 21 screwed into an inner thread of centre stud 17 and which is located in central axis 10 and projects over the underside of the electric hotplate 1 for securing the latter in the hob 7. Both the sealing parts 19, 20 are formed by deep-drawn sheet metal covers, the upper, cup-shaped sealing part 19 having a greater height than the lower cup-shaped sealing part 20. By means of its closed base wall extending approximately up to the outer flange edge 4 and traversed by thread bolt 21, the upper sealing part 19 engages on the lower end face of centre stud 17 against which it can be fixed by a nut (not shown) or the like. Its outer circumferential wall is outwardly deformed in ring flange-like manner, at least in parts, so that shoulder members 22 are formed, whose radial extension is at least as large or slightly larger than the width of spiral slot 11. The upper sealing part 19 by means of the shoulder members 22 is directly supported on the underside 16 of hotplate body 2 following on to the inner circumferential surface of the outer flange edge 4. Between the shoulder members 22, (the circumferential wall of the sealing part 19 ends in upwardly directed manner, so that it engages with its upper edge face on the bottom of the embedding material 15. Base wall 23 of sealing part 19 has an outer, relatively narrow ring disk-like area adjacent to the circumferential wall, with respect to which the remaining central, planar part of the base wall is downwardly displaced by means of a sloping ring step, the top of said part being located in the plane of the lower end face of the centre stud 17 and has a relatively narrow through-bore for the passage of the thread bolt 21 or a similar fixing member. The top surface of at least base wall 23, but particularly also the circumferential wall of sealing part 19, is constructed in a continuous manner over its entire extension in the form of a reflector 24, which is directed against the bottom 16 of hotplate body 2 over an area extending from the circumferential surface of centre stud 17 approximately up to the inner circumferential surface of outer flange edge 14. With respect to the outer flange edge 4, reflector 24 provides a heat shielding action and in particular the circumferential wall of the sealing member 19 reflecting on the inside reflects back the thermal radiation before it reaches the outer flange edge 4. If the sealing part 19 is not from the outset held with a limited spacing and in completely contact-free manner with respect to the outer flange edge 4, the contacting faces between sealing part 19 and edge 4 are kept extremely small as a result of the aforementioned construction, being formed by edge faces. Between the circumferential wall of sealing part 19 and the inner circumferential surface of outer flange edge 4 is provided a small spacing, at least approximately over the entire height of sealing part 19.

The flat dish-shaped sealing part 20, which is much lower than sealing part 19 also has a ring flange-like, cross-sectionally outwardly directed edge 25, which with its upper end face engages uninterruptedly on the bottom 8 of outer flange edge 4 and appropriately extends roughly up to its outer circumferential surface. Edge 25 is only slightly wider than bottom 8 of outer flange edge 4. In cross-section, edge 25 passes via a downwardly directed bend directly into the lower circumferential wall of sealing part 20, which in turn passes via a bend into the planar base wall 26 which is parallel to the bottom 8 of outer flange edge 4 or at right angles to central axis 10. In the centre of base wall 26 is provided a relatively narrow through opening for thread bolt 21 or the like. A nut 27 on thread bolt 21 is so fixed against the bottom of base wall 26 that, accompanied by slight elastic deformation of the latter, edge 25 is resiliently pressed against the bottom 8 of outer flange edge 4. Between the base wall 26 and base wall 23 can be provided at least one spacing member, e.g. a spacing sleeve surrounding thread bolt 21, so that a single nut is sufficient for fixing both sealing parts 19, 20 with respect to centre stud 17. Such a spacing sleeve is e.g. shown in FIG. 16. The upper sealing part 20, at least on the top surface of base wall 26 and in particular on its entire inside, is continuously constructed as a reflector 28, which is directed against the bottom of the upper sealing part 19. Any heat radiation passing downwards from the upper sealing part 19 is consequently reflected back upwards.

The area terminated both by the upper sealing part 19 and also between the two sealing parts 19, 29 is provided as an insulating zone 29, 30, both of which are formed by substantially hermetically sealed, air-filled cavities. The upper insulating zone 29 is positioned above the bottom 8 of outer flange edge 4 and the lower insulating zone 30 extends downwards and only slightly over bottom 8 of slange edge 4. The two sealing parts 19, 20 together form the lower seal 31 of the hotplate body, the outer flange edge being incorporated into said seal as a casing wall, whose inner circumference 32 bounds the outer circumference of the insulating zone 30.

In FIGS. 4 to 19, corresponding parts are given the same reference numerals as in FIGS. 1 to 3, but different letter are used.

Figure 4:
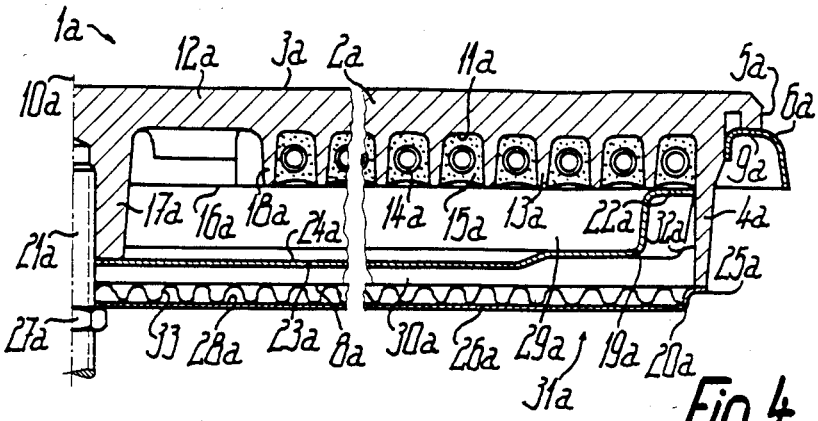
FIGS. 4 to 16, other embodiments of the electric hotplates in representations corresponding to FIG. 3.

Electric hotplate 1*a* according to FIG. 4 differs from that according to FIGS. 1 to 3 essentially only in that in the lower insulating zone 30*a* is provided an additional insulating and/or reflecting part in the form of an aluminium crinkled foil 33, which only takes up part, e.g. roughly half the smallest height of insulating zone 30*a* and is arranged in contact-free manner with respect to the upper sealing part 19*a*, in the same way as the lower sealing part 20*a*, so that the single metallic connection between the two sealing parts 19*a*, 20*a* is formed by the outer flange edge 4*a* and the thread bolt 21*a*. The aluminium crinkled foil 33 is arranged directly on base wall 26*a* of the lower sealing part 20*a* at a height which is roughly the same as the tray height of the sealing part 20*a*. It extends in uninterrupted manner approximately from the inner circumference 32*a* of the outer edge flange 4*a* over the entire ground plane of the lower sealing part 20*a* and is centrally traversed by the fixing bolt 21*a*. The outer edge of the aluminium crinkled foil 33 can be secured between edge 25*a* of sealing part 20*a* and the bottom 8*a* of the outer flange edge 4*a*. Here again, the inside of the lower sealing part 20*a* can be constructed as a reflector 28*a*, so that there are three successive reflectors. Between crinkled foil 33 and the base wall 26*a* of sealing part 20*a* are formed several cavities which are reciprocally closed and/or closed with respect to the remaining insulating cavity 30*a* and whose shape can e.g. be determined by a wavy laying of the aluminium crinkled foil 33.

Figure 5:
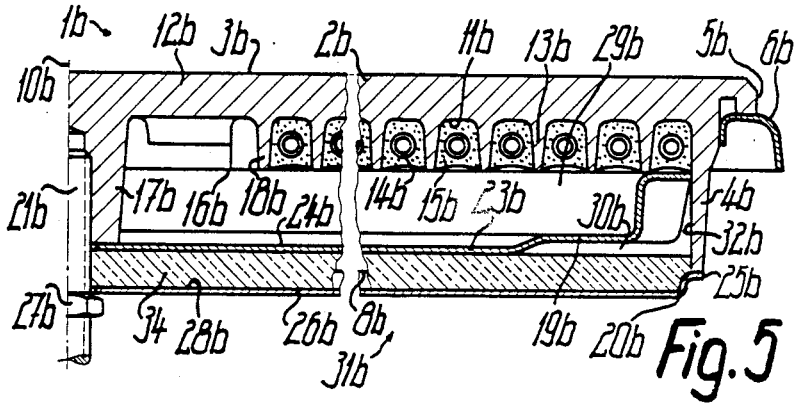
Figure 6:
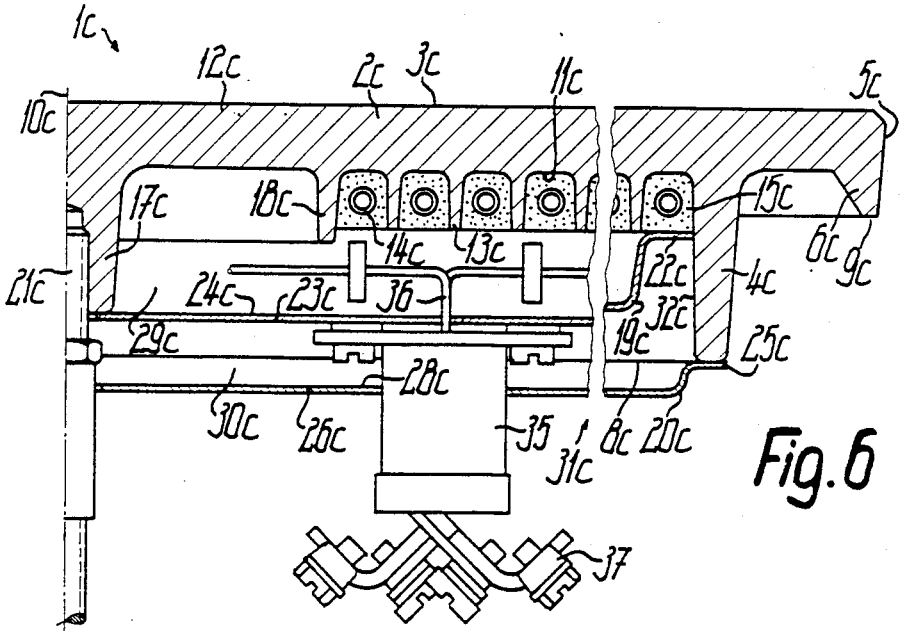

In the embodiment according to FIG. 5, most of the volume of insulating zone 30*b* is filled with insulation 34, which is appropriately located on base wall 26*b* or reflector 28*b* and extends in the manner of a plate of constant thickness only up to the underside of the central lowered region of base wall 23*b* of sealing part 19*b*. Thus, the insulation 34 is contact-free with respect to the outer, ring disk-like part of base wall 23 and with respect to the circumferential wall of sealing part 19*b*. The insulation 34 also forms the spacing member between the two sealing parts 19*b*, 20*b*, so that the two together can be fixed against centre stud 17*b* by nut 27*b* exposed on the bottom of seal 31*b* or some similar tightening member. Insulation 34 extends uninterruptedly from the outer circumference of thread bolt 21*b* to the inner circumference 32*b* of outer flange edge 4*b*. As shown in FIG. 6, at least one sealing part, particularly the upper sealing part 19*c*, can severe as a support body for a connecting member 35 for the electrical connection of heating element or elements 14*c*. Appropriately connecting member 35 is fixed to the bottom of base wall 23*c*, so that the reflector or reflectors 24*c* only has to be traversed by relatively narrow passage openings for the connecting leads 36, which connect the connecting member 35 to heating element 14*c* and are placed in the insulating zone 29*c*. The connecting member 35, which is e.g. fixed by screws in detachable manner against the bottom of base wall 23*c* and which has a casing made from insulating material traverses by its casing a through opening, having a closely adapted cross-section, in the base wall 26*c* of the lower sealing part 20*c*, so that its electric connections 37 on the underside of the casing can be freely exposed e.g. in the form of terminals on the bottom of the seal 31*c*. Connecting member 35 is appropriately nearer to centre stud 17*c* than to outer flange edge 4*c* and is appropriately located in the vicinity of inner flange edge 18*c*, which projects slightly further downwards than the remaining spiral web 13*c*. As is also shown in FIG. 6, the spillage from rim 6*c* can be directly formed by the hotplate body 2*c*, so that the ring shoulder 9*c* connected to circumferential surface 5*c* is constructed for resting on the raised edge of the hob.

Figure 7:
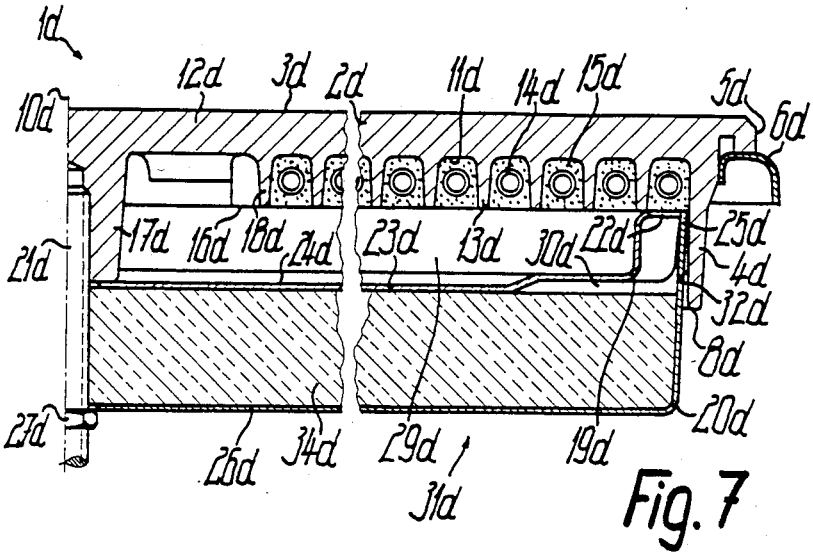

In the embodiment according to FIG. 7, edge 25*d* of the lower sealing part 20*d* does not have an angular or bent cross-section and instead forms a continuous, upwardly directed extension of the circumferential wall of the sealing part 20*d*, which extends over the level of bottom 8*d* of outer flange edge 4*d* or the bottom of the upper sealing part 19*d*. In the represented embodiment, edge 25*d* extends level with the top of the upper sealing part 19*d*, in such a way that the end face of edge 25*d* engages on the bottom 16*d* of hotplate body 2*d*. Edge 25*d* surrounds the outer circumference of sealing part 19*d* with a small clearance, its upper end face engaging either on the bottom of the shoulder member 22*d* and/or passes round the outer circumference of the sealing part 19*d* in the vicinity of its top surface and in a centering manner. In the first case, sealing part 19*d* is also secured in the vicinity of its outer circumference by means of sealing part 20*d* against the bottom 16*d* of hotplate body 2*d*. The outer circumference of the lower sealing part 20*d* engages exclusively in the vicinity of its top surface, i.e. in the region of the outer edge line of its upper edge face on the inner circumference 32*d* of the outer flange edge 4*d*, so that also in the vicinity of the circumferential wall of sealing part 20*d*, approximately over the entire associated height of edge 4*d* is provided a substantially uninterrupted clearance over its circumference between the circumferential wall and flange 4*d*, which insulates the latter with respect to the circumferential wall. In the embodiment according to FIG. 7, the height of insulating zone 30*d* is greater and in particular at least twice as great as the height of insulating zone 29*d*, whereas in the embodiment of FIGS. 1 to 3 it is only roughly half as large.

Figure 8:
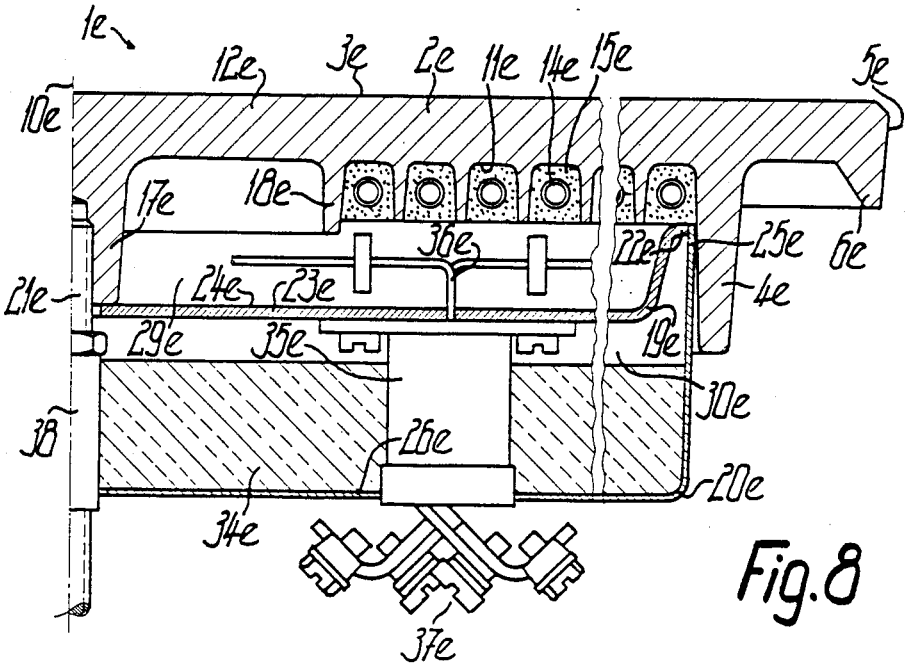

According to FIG. 8, the construction of the lower sealing part described relative to FIG. 7 can also be provided in the hotplate constructed according to FIG. 6. Insulating zone 30*d* is filled over more than half its height by insulation 34*e*, whose top surface is arranged in spaced manner below the flange plate of the connecting member 35*e* fixed to the sealing part 19*e* or the fixing screws thereof. Unlike in the case of FIG. 6, the flange plate is directly arranged in whole-area manner on the bottom surface of sealing part 19*e* and not by means of spacing parts engaging over small areas. The lower end of the casing of connecting member 35*e* which is at right angles to cooking surface 3*e* and is provided on its top surface with the outlet for connecting leads 36*e* is arranged roughly level with the base wall 26*e* of sealing part 20*e*, so that it only slightly projects downwards over base wall 26*e* and the leads 37*e* provided on its bottom surface are located directly below sealing part 20*e*. The casing of connecting member 35*e* is embedded in insulation 34*e* over the entire thickness thereof. For the close connection of insulation 34*e* to the thread bolt 21*e* is provided a sleeve 38 which surrounds the latter and which is e.g. mounted on thread bolt 21*e* and passes through the entire thickness of insulation 34*e*, so that the insulation engages on the outer circumference of sleeve 38. Sealing parts 19*e*, 20*e* are made from varying thick sheet metal, the sheet metal of sealing part 19*e* being thicker and in particular twice as thick as that of sealing part 20*e*.

Figure 9:
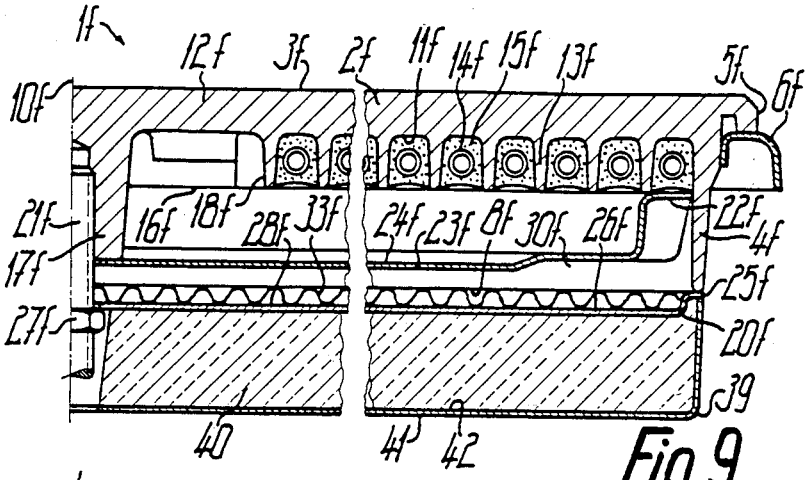

In the embodiment according to FIG. 9, there are three superimposed sealing parts 19*f*, 20*f*, 39 in the form of cover plates, the two lower parts 20*f*, 39 surrounding a further insulating zone and which is at least partly and in particular completely filled with an insulation 40 of at least one of the described materials. Sealing parts 19*f*, 20*f* are constructed in accordance with sealing parts 19, 20 of FIG. 3, whilst sealing part 39 has a reduced height corresponding to sealing part 20*d* according to FIG. 7. The upper edge of sealing part 39 is in engagement with the bottom and/or outer circumference of the ring flange-like edge 25*f* of the sealing part 20*f* and therefore has its upper edge face on the bottom 8*f* of the outer edge flange 4*f*. The circumferential wall of the sealing part 20*f* engaging from above approximately over its entire height in sealing part 39 is spaced from the circumferential wall of sealing part 39, which cross-sectionally over its entire height passes through in an approximately linear manner and on its lower end connects the through, planar base wall 41 of sealing part 39 which is at right angles to central axis 10*f*. At least the top surface of base wall 41 and in particular the entire inner surface of sealing part 39 is constructed as a reflector 42. As described relative to FIG. 4, in sealing part 20*f* is provided a crinkled foil 33*f* or the like, e.g. made from aluminium as a reflector and insulating layer. Thus, in superimposed manner, there are three or four reflectors and two insulation layers separated from one another by sealing part 20*f* and two insulating cavities separated by the sealing part 19*f*. Whilst optionally incorporating an insulating 40, sealing parts 20*f*, 39 can be joined together to form one component, e.g. welded in the vicinity of there engaging edges.

Figure 10:
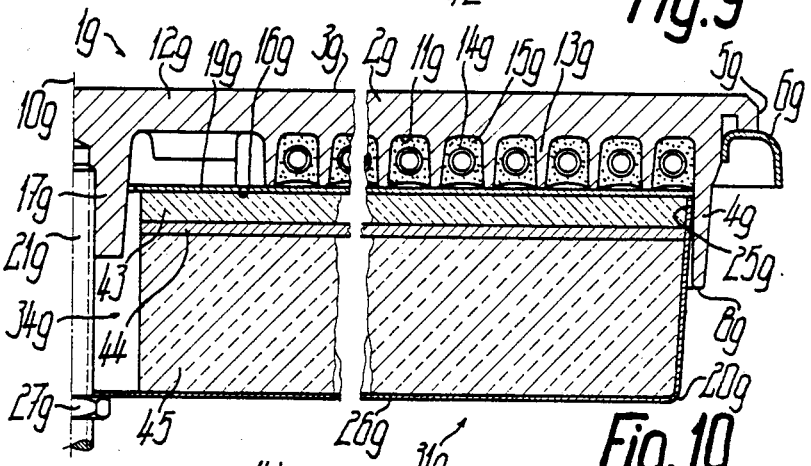

In the embodiment according to FIG. 10, the upper sealing part 19*g* is formed by a planar plate, whose top surface engages on the bottom surface 16*g* of hotplate body 2*g* and which extends with its circumference side edge face approximately to the inner circumference of outer flange edge 4*g*. Between sealing part 16*g* and the lower sealing part 20*g* constructed in accordance with FIG. 7 is provided a multilayer insulation 34*g* substantially completely filling the associated insulating zone and which is only centrally provided with a through opening for the passage of the center stud 17*g* and the thread bolt 21*g*. In the represented embodiment, there are three separate layers 43, 44, 45 made from different insulating materials and/or different compression densities. The bottom, thickest layer 45, which extends above the bottom 8*g* of the outer flange edge 4*g* bounds the thinnest, appropriately hardest, compressed layer 44, on whose top surface rests the medium thickness layer 43, whose bottom surface bounds the sealing part 19*g*. One or the central layer 44 can also be constructed on its top surface as a reflector and can e.g. be formed by a sheet metal plate. As in the embodiments according to FIGS. 7 to 9, here again the lower seal 31*g* projects relatively well over the bottom 8*g* of the outer flange edge 4*g* and at least by the height thereof.

Figure 11:
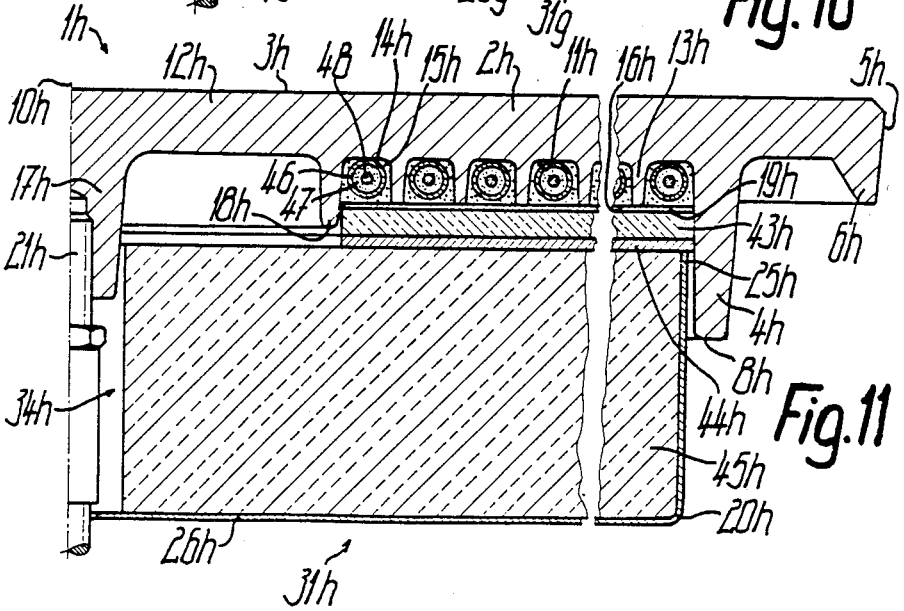

In the embodiment according to FIG. 11, heating element 14*h* or the heating elements are formed by a tubular heater, which comprises a resistance heating wire 48 arranged within an outer tube casing 46 and is kept spaced therefrom by embedding in an insulating embedding material 47. The spirally positioned tubular heater is arranged in spiral slot 11*h* and can be embedded in the described manner in an embedding material 15*h* connecting onto the outer circumference of a tube casing 46 and which substantially completely fills the spiral slot 11*h* and provides a particularly good thermal coupling to the hotplate body 2*h*. The upper, plate-like sealing part 19*h* is located, as described relative to FIG. 10, in engagement on the bottom of hotplate body 2*h*, but its inner circumference only extends up to the outer circumference of the further downwardly projecting inner edge flange 18*h*, which also applies for the insulating layer 43 located immediately below it and for the layer 44*h*. However, layer 45*h* extends almost up to the outer circumference of center stud 17*h*. However, in this embodiment, edge 25*h* of sealing part 20*h* engages by its upper edge face on the bottom of layer 44*h*, so that said edge 25*h* for the entire circumferential wall of sealing member 20*h* can be kept spaced from the inner circumference of outer edge flange 4*h*. In this embodiment, a reflector or reflectors are only provided in the heated zone of hotplate body 2*h*, whilst the zone 12*h* free from heating elements which surrounds the central axis 10*h* only up to the outer circumference of the inner flange edge 18*h* is only covered on the bottom surface by an insulation, which passes through in one part in the height direction.

Figure 12:
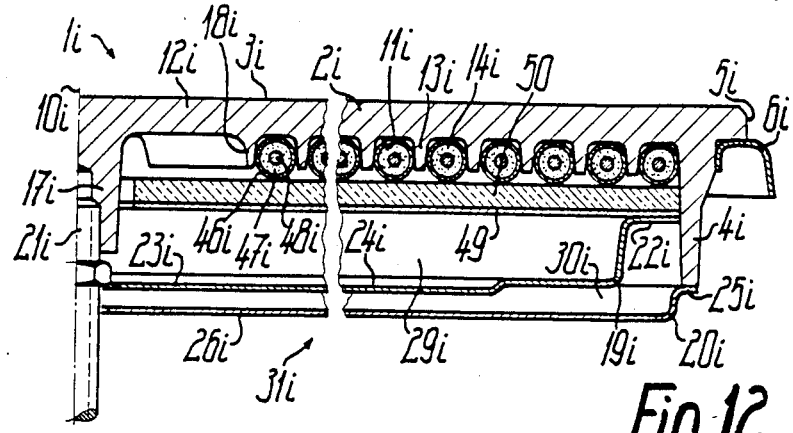

In the embodiment according to FIG. 12, the height of the spiral web 13*i* is smaller than the external diameter of the heating element 14*i*, e.g. formed by a tubular heater, so that it projects slightly over the bottom of spiral web 13*i*. The heating element 14*i* is not embedded in spiral slot 11*i* and is instead loosely placed in the cross-sectionally upwardly tapering spiral slot 11*i* in such a way that its outer circumference is in contact both with the base face and the two side faces and to this extent is thermally very well coupled. Heating element 14*i* is pressed upwards into the spiral slot 11*i* by the sealing member 19*i* supported in prestressed manner on its bottom and is consequently kept in good thermal conducting engagement, despite thermal stresses. for this purpose, sealing member 19*i* is provided on its top surface with a flat plate, which may be fixed thereto and which can be constructed in accordance with the sealing part 19*g* according to FIG. 10 and appropriately is constructed as a reflector plate 49, i.e. on its top surface as a reflector. On said plate is provided an insulating plate 50 which is much thinner than the height of the outer flange edge 4*i* and the sealing part 19*i* and which has a certain pressure elasticity, so that it transfers in the manner of a permanent elastic intermediate layer the contact pressure of sealing part 19*i* to heating element 14*i*. Insulating plate 50 is spaced below spiral web 13*i* and to the extent that it projects radially inwards into this area, is also spaced below the inner flange edge 18*i*. In the interior, sealing part 19*i* forms the completely hollow insulating zone 29*i*, whilst below it is provided the much lower insulating zone 30*i*.

Figure 13:
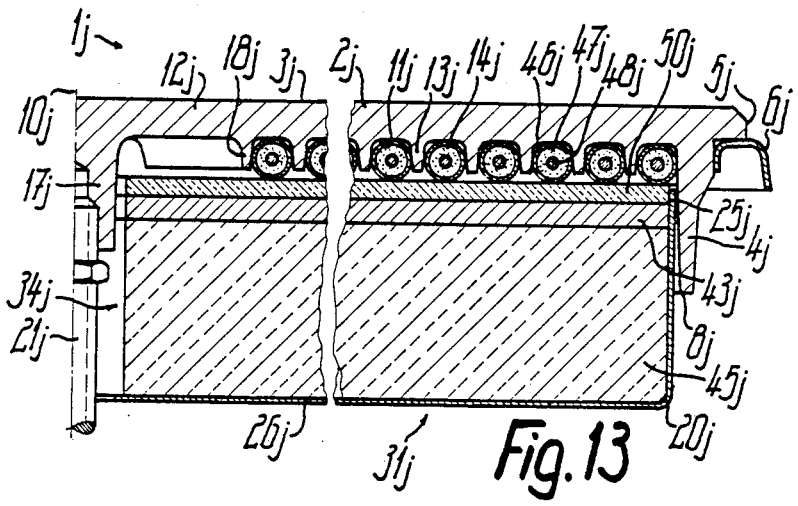

In the embodiment according to FIG. 13, only the bottom sealing part 20*j* is formed by a sheet metal plate, whilst the upper sealing part is formed by insulating plate 50*j*, which engages in the upper edge 25*j* of sealing part 20*j* in such a way that it projects upwards slightly above its upper edge face. Below insulating plate 50*j* is provided a further layer 44*j* of roughly the same thickness, which can also be made from insulating material, but is appropriately less strongly compressed. The layer 45*j* filling the adjacent space below it corresponds to that according to FIG. 11.

For corresponding installation cases, the lower seal 31*k* of hotplate body 2*k* can, at least in the vicinity of its bottom surface, be free of any sheet metal part and can be formed on its bottom surface solely by an insulating material body 45*k*, which is pressed by clips or similar fixing means only partly covering its bottom surface against the bottom surface of hotplate body 2*k*, said fixing means simultaneously serving for fixing electric hotplate 1*k* into the hob. According to FIG. 14 the upper sealing part is only formed by insulating plate 50*k*, so that seal 31*k* has no sheet metal parts. The bottom of hotplate body 2*k* has no projecting spiral web and optionally also no inner flange edge, so that it is completely planar between the inner circumference of outer flange edge 4*k* and the outer circumference of centre stud 17*k*. Heating element 14*k* engages on this planar face and in particular in this case the heating element can have a cross-sectionally flattened portion, e.g. with a semicircular or triangular construction, with which it appropriately engages on the associated overlying bearing face of hotplate body 2*k*.

Figure 14:
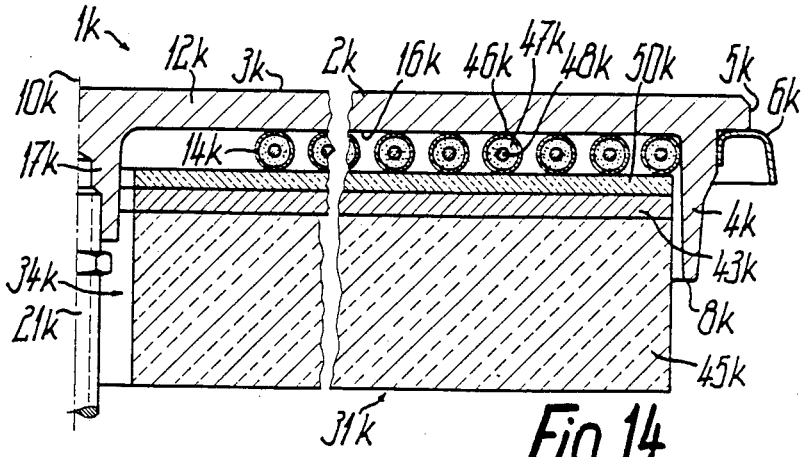
Figure 15:
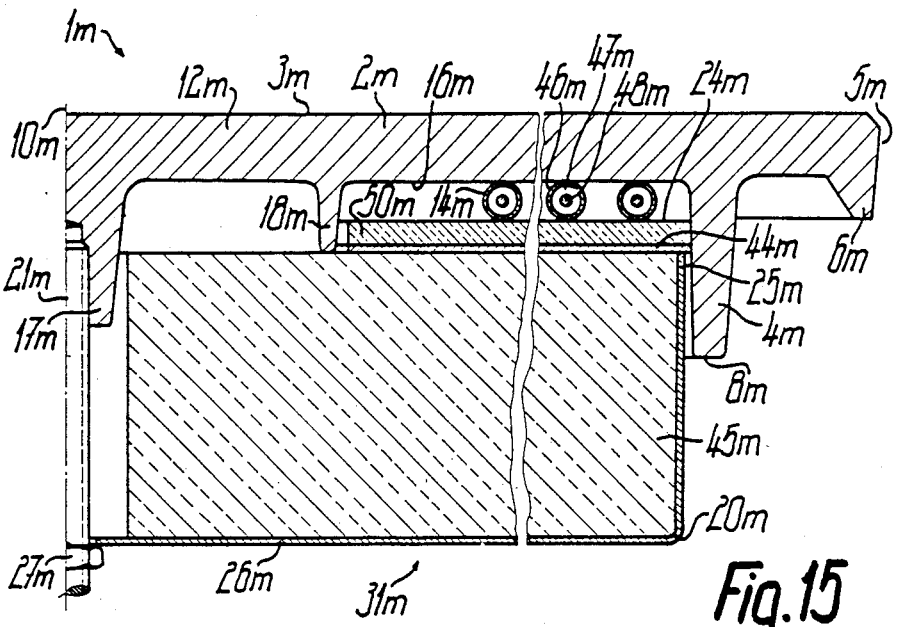

The embodiment according to FIG. 15 has a heating element 14*m* arranged and constructed similarly to that of FIG. 14, but the hotplate body 2*m* and lower seal 31*m* are constructed much as in FIG. 11. Hotplate body 2*m* has an inner flange edge 18*m*, from which the innermost turn of the heating element 14*m* is spaced. Insulating plate 50*m* engages directly on heating element 14*m* and is supported on its underside by a reflector plate 44*m*, whose bottom surface is roughly located in the plane of the bottom surface of the inner flange edge 18*m*. As a result the insulating layer 45*m* is connected to the bottom of inner flange edge 18*m*, so that heating element 14*m* is located substantially freely in a cavity closed on both the inner and outer circumferences.

Figure 16:
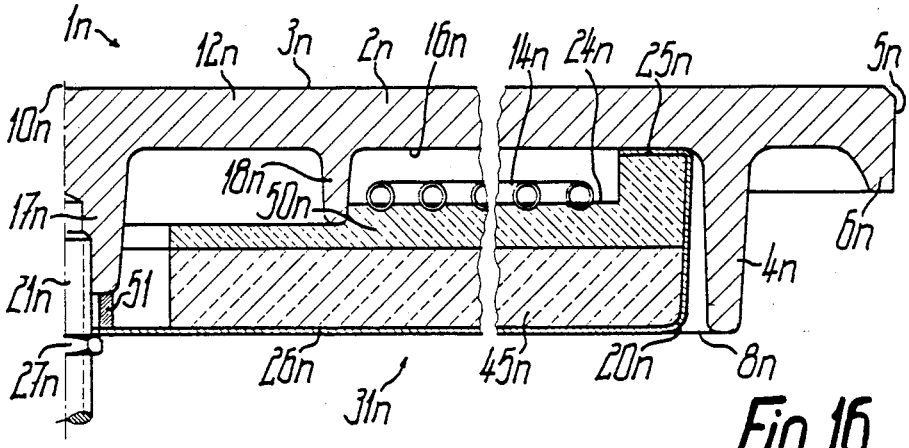

In the embodiment according to FIG. 16, heating element 14*n* is arranged in a closed cavity, but said heating element 14*n* is in the form of a radiant heater and is spaced below the planar bottom 16*n* of hotplate body 2*n*. Sealing part 20*n*, whose base wall 26*n* is roughly in the plane of the bottom 8*n* of the outer flange edge 4*n* extends with its circumferential wall up to the bottom 16*n* of the hotplate body 2*n*, the upper edge 25*n* of said circumferential wall engaging in ring flange-like manner on the bottom 16*n* and is inwardly direct. Sealing part 20*n* receives a lower insulating layer 45*n* and an overlying insulating material layer 50*n* which serves as a support for the heating element 14*n*, so that heating element 14*n* is at least partly fixed in position by embedding in said support layer. On the outer circumference of the heating zone having heating element 14*n*, layer 50*n* projects upwards over said heating element and extends up to edge 25*n*, so that the space receiving the heating element is defined on the outer circumference by said layer 50*n* approximately up to bottom surface 16*n*. On the inner circumference of the heating zone, layer 50*n* engages in the inner flange edge 18*n* in such a way that it partly surrounds the underside and outer circumferential surface thereof, layer 45*n* extending into the heating element-free zone 12*n*. Bottom wall 26*n* of sealing part 20*n* is fixed against the bottom of centre stud 17*n*, whilst interposing a spacing sleeve 51 surrounding thread bolt 21*n*.

Figure 17:
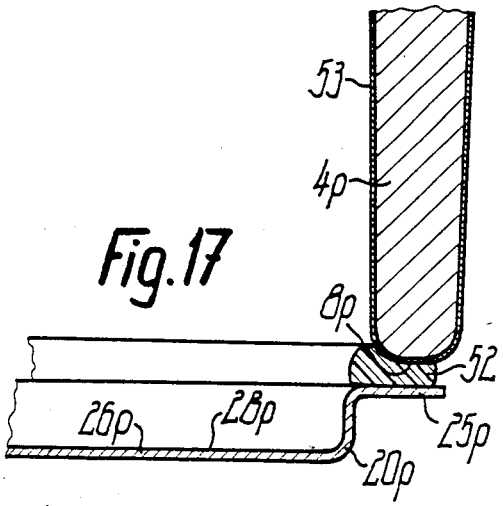
FIG. 17, another embodiment in a view corresponding to a detail of FIG. 3, but on a larger scale.
Figure 18:
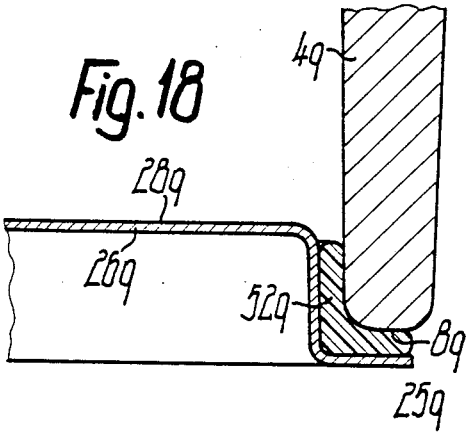
FIGS. 18 and 19, two further embodiments in representations corresponding to FIG. 17.
Figure 19:
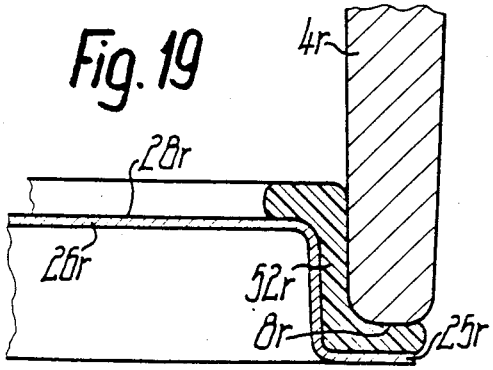

As shown in FIG. 17, sealing part 20*p* can engage in the outer flange edge 4*p*, whilst interposing a ring packing 52, which is in cross-section approximately flat and rectangular and is fixed between the bottom 8*p* of the outer flange edge 4*p* and edge 25*p* of sealing part 20*p*. On both the inner and outer circumferential surfaces and on the bottom 8*p*, outer flange edge 4*p* is provided with an uninterrupted surface coating 53, which can e.g. be of silicone. The base wall 26*q* of sealing part 20*q* can, according to FIG. 18, be located above edge 25*q* thereof, so that the sealing part 20*q* engages from below in centered manner in the outer flange edge 4*q* and a cross-sectionally angular ring packing 52*q* or a ring packing located between the inner circumference of the outer edge flange 4*q* and the outer circumference of the circumferential wall of the sealing part 20*q* can be used. The ring packing 52*r* according to FIG. 19 is cross-sectionally approximately Z-shaped, so that it also engages on base wall 26*r* of sealing part 20*r*.

What is claimed is:

1. An electric hotplate, comprising;

a hotplate body (2) formed by a solid body of metallic material, said hotplate body (2) having a top surface defining a cooking surface (3) and having a bottom side provided with a downwardly projecting outer flange (4) arranged around an annular heating zone and having an underside (8);

at least one electric heating element (14) located within said outer flange (4), in the annular heating zone;

a seal (31) on a lower side of the hotplate, the seal being provided below said heating element (14), said seal (31) incorporating the outer flange (4) and comprising at least two superimposed sealing parts (19, 20) forming an upper sealing part and a lower sealing part;

at least the upper sealing part (19) providing a reflector (24) located within the outer flange (4) and directed toward the bottom side (16) of the hotplate body (2), said reflector (24) extending substantially at most down to the underside (8) of the outer flange (4);

an insulating zone (30) being provided below the reflector (24) and extending substantially from the outer flange (4) across the heating zone, said insulating zone shielding the reflector (24) and being bounded by the lower sealing part (20);

a connecting member (35) electrically connected to the heating element (14), provided in the vicinity of the seal (31), wherein the connecting member (35) is supportedly mounted on the upper sealing part (19*c*, 19*e*) of said seal (31*c*).

2. An electric hotplate according to claim 1, wherein said upper sealing part (19*c*) has a base wall (23*c*) providing a bottom side, said connecting member (35) being fixed to said base wall (23*c*) and bearing on said bottom side.

3. An electric hotplate according to claim 1, wherein the connecting member (35) is detachably mounted to the upper sealing part (19*c*).

4. An electric hotplate according to claim 1, further comprising screws, the connecting member (35) being fixed by the screws to the upper sealing part (19*c*).

5. An electric hotplate according to claim 1, wherein the connecting member (35) has a flange plate fixed to the upper sealing part (19*c*).

6. An electric hotplate according to claim 1, wherein the connecting member (35) has a casing made from insulating material, and further comprising electric connection elements (37) on the casing.

7. An electric hotplate according to claim 1, wherein the lower sealing part (20*c*) has a base wall (26*c*), said connecting member (35) passing through said base wall (26*c*) at an opening closely dimensioned to match a cross-section of the connecting member (35).

8. An electric hotplate according to claim 1, wherein the casing of the connecting member (35*e*) has a lower end arranged substantially level with the base wall (26*e*) of the lower sealing part (20*e*).

9. An electric hotplate according to claim 1, wherein the insulating zone (30*e*) is at least partly filled with an insulating material (34*e*) having an insulating thickness, said connecting member (35*e*) being embedded in the insulating material (34*e*) substantially along the entire insulating thickness.

10. An electric hotplate according to claim 9, wherein the connecting member (35) has a flange plate and the insulating material (34*e*) has a top surface arranged at a space below the flange plate.

11. An electric hotplate according to claim 1, wherein said upper and lower sealing parts (19*e*, 20*e*) are made from sheet metal, each having a sheet thickness, the sheet thickness of said upper sealing part (19*e*) being larger than the sheet thickness of the lower sealing part (20*e*).

12. An electric hotplate according to claim 1, wherein on the bottom (16) of said hotplate body (2) a center stud (17c) and an inner flange (18c) are provided, the connecting member (35) being located nearer to the center stud (17c) than to the outer flange (4c) and adjacent the inner flange (18c).

13. An electric hotplate, comprising:

a hotplate body (2) formed by a metallic solid body having a top surface defining a cooking surface (3), said hotplate body (2) having a bottom side provided within a downwardly projecting outer flange around an annular heating zone;

at least one electric heating element (14) arranged in the annular heating zone;

a seal (31) on a lower side of the hotplate, the seal being provided below said heating element (14), said seal (31) incorporating the outer flange (4) and comprising at least two superimposed sealing parts forming an upper sealing part (19) and a lower sealing part (20), each having edges;

at least the upper sealing part (19) providing at least one reflector (24) located within the outer flange (4) and directed toward the bottom side (16) of the hotplate body (2), said reflector (24) extending substantially at most down to an underside (8) of the outer flange (4);

an insulating zone (30) being provided below the reflector (24) and extending substantially from the outer flange (4) across the heating zone, said insulating zone shielding the reflector (24) and being bounded by the lower sealing part (20), and wherein a center stud (17) projects from the bottom side (16) of the hotplate body (2) below the heating element (14) and engages the upper sealing part (19) and extends into the insulating zone (29) of the seal (31).

14. An electric hotplate according to claim 13, wherein the reflector (24) provides a reflective heat shield shielding the outer flange (4) against thermal radiation from the heating zone.

15. An electric hotplate according to claim 13, comprising successive upper and lower reflectors (24, 28) made from sheet material and provided in superimposed manner, the lower reflector being provided in the insulating zone (30) located below the upper reflector (24).

16. An electric hotplate according to claim 15, wherein at least one of said upper and lower reflectors (24, 28) and the lower sealing part (20) is formed by a cup-shaped sheet metal cover having an edge (22, 25) engaging with the outer flange (4).

17. An electric hotplate according to claim 13, wherein an upper insulating zone (29) is defined between the heating element (14) and the upper sealing part (19), the upper insulating zone (29) having a height substantially equal to a height of an end portion of the center stud (17) of the hotplate body (2) projecting beyond an underside of the heated zone, the center stud being shorter than the outer flange (4).

18. An electric hotplate according to claim 13, wherein an upper insulating zone (29b, 30b) is defined between the heating element (14) and the upper sealing part, the upper insulating zone being provided with at least one of a reflecting material and a thermally insulating material.

19. An electric hotplate according to claim 13, further comprising at least one thermally insulating, reflective material layer bounding a superimposed cavity (30a) in the seal, said layer being formed by a metallically bright crinkled foil (33).

20. An electric hotplate according to claim 13, wherein the edge (22i) of at least one (19i) of said upper and lower sealing parts is at least partly outwardly directed to define a flange-like ring located adjacent an underside of the heating zone, and further comprising a reflector plate (49) on the edge, covering a top surface of said at least one sealing part (19i).

21. An electric hotplate according to claim 13, wherein the edge (25) of the lower sealing part (20) is directed outwards to define a flange-like ring, said edge (25) frontally engaging on an underside (8) of the outer flange (4) of the hotplate body (2).

22. An electric hotplate according to claim 13, wherein the edge (25p) of the lower sealing part (20p) sealingly engages the outer flange (4p) of the hotplate body, a ring packing (52) being interposed between the edge and the outer flange (4p).

23. An electric hotplate according to claim 13, wherein the edge (25n) of one of the sealing parts (20n) is inwardly directed to define a flange-like ring and engages on the bottom side (16n) of the hotplate body (2n) adjacent to the heating element (14n).

24. An electric hotplate according to claim 13, wherein the edge (25d) of one of the sealing parts (20d) has a substantially constant width up to an upper end thereof and substantially up to an underside of the heating zone, and engages in an inner circumference (32d) of the outer flange (4d).

25. An electric hotplate according to claim 13, wherein at least adjacent the outer flange (4d) the hotplate body is provided with a water-repelling surface coating (53).

26. An electric hotplate according to claim 13, further comprising a filling means made from insulating material disposed in at least one insulating zone in the seal comprising at least two superimposed layers (43, 44, 45), at least a top layer of the at least two superimposed layers being provided on an upper surface with a reflector (19g).

27. An electric hotplate according to claim 13, wherein the at least one heating element (14) includes a resistance wire heating coil embedded in a ceramic embedding material (15) in a rib-defined spiral slot (11) on the bottom side (16) of the hotplate body (2), an insulating cavity (29) being provided on a bottom surface of said embedding material, bounded by the at least one reflector (24).

28. An electric hotplate according to claim 13, wherein the least one heating element (14k) includes a spirally arranged tubular heater having a resistance heating wire (48k) embedded in an insulating embedding material (47k) within an outer tube casing (46k), said tubular heater being pressed against the bottom of hotplate body (2k) by means of a flat insulating plate (50k) extending through the heating zone.

29. An electric hotplate according to claim 13, wherein the at least one heating element (14n) includes a radiant heater arranged in spaced manner below the bottom side (16n) of the hotplate body (2n) on a top surface of an insulator (50n) forming the reflector (24n).

* * * * *